US005210969A

United States Patent [19]

Suarez

[11] Patent Number: 5,210,969

[45] Date of Patent: May 18, 1993

[54] MOVING ADVERTISING DISPLAY

[76] Inventor: Fernando Suarez, 979 Cgetenne St., Costa Mesa, Calif. 92626

[21] Appl. No.: 632,879

[22] Filed: Dec. 24, 1990

[51] Int. Cl.[5] ..... G09F 11/30

[52] U.S. Cl. ..... 40/509; 40/476

[58] Field of Search ..... 40/446, 476, 487–491, 40/508–511

[56] References Cited

U.S. PATENT DOCUMENTS

| | | | |
|---|---|---|---|
| 1,510,502 | 10/1924 | Roth | 40/476 |
| 3,797,144 | 3/1974 | Weggeland | 40/476 |
| 3,849,919 | 11/1974 | Gravelle et al. | 40/476 X |
| 4,688,342 | 8/1987 | Bronaugh, Sr. et al. | 40/511 |

*Primary Examiner*—Kenneth J. Dorner
*Assistant Examiner*—Milton Nelson, Jr.
*Attorney, Agent, or Firm*—Singer & Singer

[57] ABSTRACT

A plurality of different advertising messages is displayed in a mechanical and repetitive manner. The size of the message is determined by the number of moveable panels used. A complete message can be shown on as little as two moveable panels or as many as an even multiple of two panels. Each panel is rectangular in shape and mounted with the long edge vertical. Each pair of panels are moved sequentially, first longitudinally and then transversely until a new message is displayed. The process is repeated sequentially to display each new message in turn. The total number of panels is determined by the number of messages and the size of each message to be displayed with each panel being located on a moveable carrier. The carriers are prevented from twisting and jamming by discrete springs and transfer guides that maintain a preferred relationship of the carrier when being moved.

12 Claims, 7 Drawing Sheets

FIG. 12
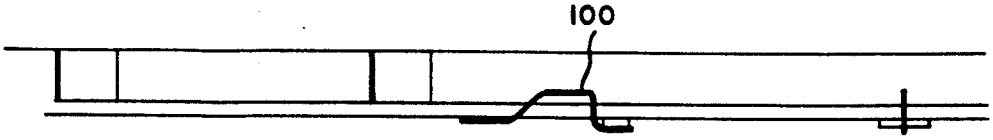
FIG. 13
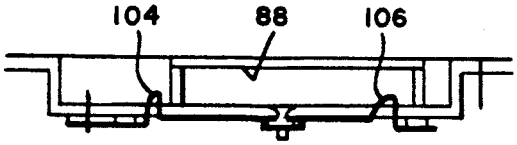
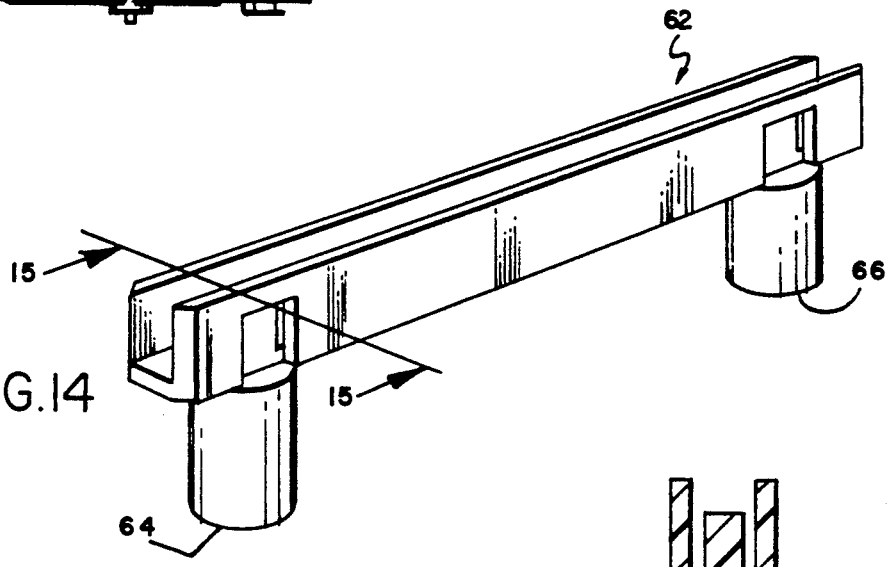
FIG. 14
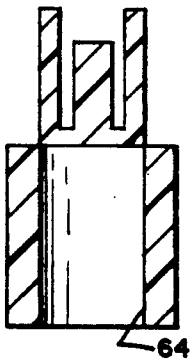
FIG. 15
FIG. 16
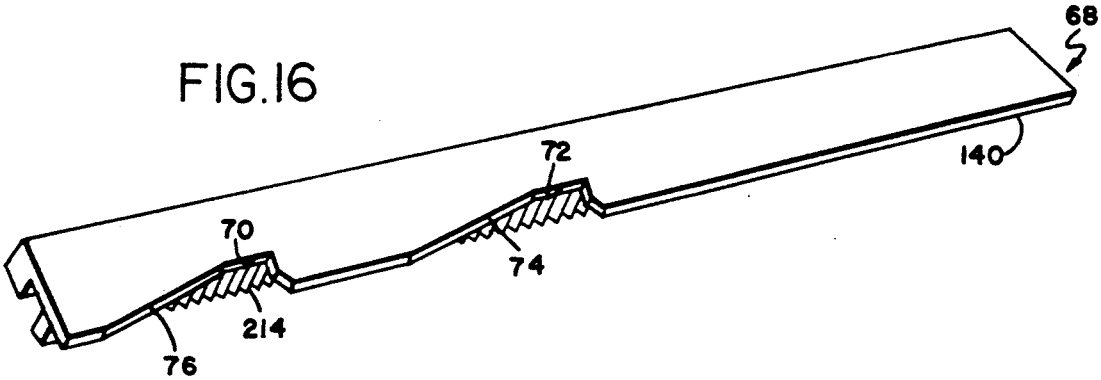

MOVING ADVERTISING DISPLAY

This invention relates generally to a moving display advertising machine and more particularly to a display advertising machine in which jamming of the carriers holding the display panels has been eliminated by preventing the carriers from twisting when being moved by maintaining the carriers in a preferred relationship when being moved longitudinally and transversely.

The overall concept of the display device is very straight forward and requires only that a display panel containing a message be placed on a carrier for display to the general public. The carrier is moved first in a longitudinal direction and then in a transverse direction to remove the old message and allow a subsequent carrier to move in position and display a new message. The process is repeated sequentially until all messages are displayed and the process repeated again and again.

In the most general form, a plurality of different advertising messages are located on different advertising panels which are then sequentially rotated over a period of time with each panel being displayed sequentially. It is important that the changing time be small when compared to the display time since income is a function of how long the advertising message is available for display to the general public.

The actual size of the advertising message is a function of how many panels are used to display a single message. Since each display panel is about four (4) inches wide and the complete display is usually located 8 to 10 feet from the viewer it has been determined that a total display of about five (5) feet is most desired in order to capture the attention of the moving public. It is possible to make the total display smaller or larger; however, 5 feet is considered a desideratum.

In the preferred embodiment, the total display is made up of a plurality of base modules each capable of handling a pair of display panels. For a system capable of displaying a 5 foot advertising message a total of 6 base modules are necessary, all working together under the control of a single program timer. Since each advertising message is contained on at least 2 advertising panels, the message can be as large as two times the number of base modules used. Larger advertising messages can be shown by using multiples of display boxes, with the total size of the advertising message being determined by the number of display boxes used.

To understand the operation, a review will be made of a single display box containing two display panels comprising a complete advertising display. Each base module is comprised of a pair of spaced apart longitudinal tracks each comprised of a single track. Both longitudinal tracks communicate with first and second transverse spaced apart tracks extending between the longitudinal tracks. Each of the transverse tracks comprise a pair of tracks for accepting a panel carrier.

Panel carriers located in the front longitudinal track are moved left to right by a first moveable rack while at the same time panel carriers located in the rear longitudinal track are moved right to left by a second moveable rack. Panel carriers located in the right transverse tracks are moved by a pusher bar that moves the carriers to the rear longitudinal track while at the same time panel carriers located in the left transverse tracks are moved by a pusher bar forward to the front longitudinal track.

Each display box is capable of sequentially displaying six advertising messages with each message being displayed on two display panels at any given time. A panel carrier, one for each display panel, is adapted to move first in the front longitudinal track from left to right into a pair of transverse tracks located on the right. The panel carrier is then moved rearward through a pair of transverse tracks to the rear longitudinal track at which time it is moved through the rear longitudinal track from right to left to a pair of transverse tracks located on the left. The panel carrier is then moved forward to the front longitudinal track where the process is repeated over and over.

In actual practice, all movements in each display box are duplicated in that whenever a carrier is moved from left to right in the front longitudinal track, a carrier is also being moved in the rear longitudinal track from right to left. In a similar fashion, whenever a carrier is moved rearward in the right pair of transverse tracks, a carrier is moved forward in the left pair of transverse tracks.

The panel carriers are moved through each longitudinal track by a sliding rack associated with each longitudinal track. The sliding rack for the front longitudinal track only moves the carrier from left to right while the sliding rack for the rear longitudinal track only moves the carrier from right to left. Movement of both racks are synchronized so that when the front rack is moving to the right, the rear rack is moving to the left and visa versa. The individual panel carriers are loaded into cammed detents located in each rack which cause the carriers to move the panel carrier only in one direction. Panel carriers in the front are only moved to the right while panel carriers in the rear are only moved to the left.

A review of the movements required will show that for each two pairs of panels that at least four movements of each rack are necessary to remove the old display and present a new display. We will assume a starting position with both the front and rear pusher bars retracted and the front rack at the left and the rear rack at the right.

To remove the old display comprising two panels and insert a new display comprising two panels, the carrier of the display panel on the right is moved transversely to the rear by the front pusher bar while at the same time the rear pusher bar moves forward to load the front rack. Both front and rear racks are energized which moves the front loaded carrier to the right and the rear loaded carrier to the left. The process is repeated again with the pushers again loading the front and rear rack. The front and rear racks are again energized thereby placing two new display panel with one on the right and one on the left for viewing. The process repeats with both pusher bars retracting and the front rack moving to the left and the rear rack moving to the right.

It is quite obvious, that moving the old display out and moving the new display in position must be done as fast as possible in order to increase the time that each advertising message can be displayed. Advertisers pay on the basis of how long a display is presented before the public in any given period of time. If more time is spend in moving panels in any given period of time, then less time is spent for display. In other words revenue is a function of display time and not set-up time. Should an advertising machine take excess time to set-up it will not be economically feasible. A perfect example of "time is money".

An object of the present invention, therefore, is to increase the speed of setting up the advertising display.

Another object is to remove the tendency of the carriers holding the display panels from jamming when being moved.

The prior art has recognized the advantages of using a moving display advertising machine for displaying different advertising messages in a repetitive fashion.

Such devices are best illustrated in U.S. Pat. No. 4,688,342 issued Aug. 25, 1987 to William Bronaugh. The Bronaugh patent is the most modern of the moving display advertising machines. The mechanism for moving the panel carriers from the longitudinal track to the transverse track is fully illustrated. Unfortunately the Bronaugh device is exceeding slow in setting up each new advertising display relative to the time spent in displaying the advertising message. This time delay results from Bronaugh requiring two separate motions of the rack when moving a panel carrier. One motion is needed to move the carrier and a second motion needed to unload the rack. The present invention unloads the rack by cam action when the racks are returned thereby eliminating a set-up motion.

Since two set-up movements are necessary to view a two panel advertising display, the Bronaugh device requires an additional two movements to unload the racks thereby spending more time setting the display and leaving less time for viewing the message. This alone make the Bronaugh device economically unfeasable.

An additional problem with all the prior art devices, including Bronaugh, is a tendency for the panel carriers to jam as they are moved. The jamming action is similar to a Chinese finger puzzle that allows the finger to be inserted but immediately locks-up when an attempt is made to withdraw the finger. The rings of the puzzle are aligned when the finger is inserted but twist at an angle when withdrawn. Moving the rings at an angle to the finger causes the rings to lock together and to the finger.

In the prior art the panel carriers are free to move at an angle to each other when being moved thereby allowing the individual carriers to lock together and jam as in the Chinese finger puzzle. To remove the jam it is necessary to stop the machine and realign the carriers before movement is again possible.

The prior art did not recognize the problem and attempted to reduce jamming by lubrication and by the use of ball bearings to reduce friction. Unfortunately, the problem is not a material or friction problem but rather one of structure and design.

There are of course other display devices in the art such as U.S. Pat. No. 1,125,393 issued to Proulx on Jan. 19, 1915. The basic principle of moving the panel carriers is shown including the use of springs for advancing the carriers in the transverse mode. Unfortunately, the use of spring pressure to move the carrier contributes to the jamming problem since there is no guarantee that the carriers will not twist and jam. Unless the carriers are moved under positive control and prevented from twisting, the problem of jamming exists and will occur.

Other Patents showing the prior art of display advertising machines include U.S. Pat. No. 1,465,304 to Hinchey, U.S. Pat. No. 1,179,096 to Hamilton, U.S. Pat. No. 2,016,748 to Lewyt, British Patent 468,947 to Horstmann, U.S. Pat. No. 1,972,422 to Kauffman, U.S. Pat. No. 1,685,499 to McDonald and U.S. Pat. No. 1,811,720 to Kauffman.

These prior art patents represent the best art for illustrating the advertising display devices. Unfortunately, the problem of preventing jamming as a result of the twisting of the panel carriers is not recognized. Many of the prior patents claim to make the movement more efficient by using ball bearings or special tracks or as shown in the latter patents by using plastic carriers. Unfortunately, the problem is not a materials problem but rather a structure problem that has not been recognized until the advent of the present invention.

In the present invention, jamming is preventing by maintaining the panel carriers in a preferred relationship when being moved. Springs are located in each of the tracks to maintain an orthogonal relationship of the carriers to the transverse track when being moved from the longitudinally to the transverse track and when being moved in the transverse track. The panel carriers are prevented from moving at an angle to the walls of the transverse track and in this manner jamming is prevented and the speed of transferring panels is increased.

Further objects and advantages will be made more apparent by referring now to the accompanying drawings where there is shown:

FIG. 12 is a section of FIG. 4 taken along lines 12—12;

FIG. 13 is a section of FIG. 4 taken along lines 13—13;

FIG. 14 is a perspective view of a panel carrier;

FIG. 15 is a section of FIG. 14 taken along lines 15—15;

FIG. 16 is a perspective view of a sliding rack used to move the panel carriers in the longitudinal tracks.

Figure 1:
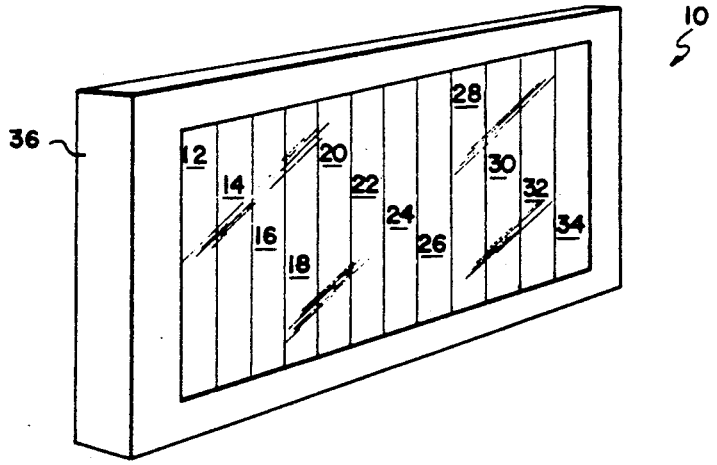
FIG. 1 illustrates the external parameters of a typical advertising display device.

Referring now to FIG. 1 there is shown a complete advertising display device 10 comprising 12 display panels 12, 14, 16, 18, 20, 22, 24, 26, 28, 30, 32 and 34. All the display panels are set in a display case 36 which holds all the panels and the drive mechanism. The display case 10 will typically be located in a heavily trafficked area such as a mall, railroad station or similar area where a large number of people congregated and move about.

The display device 10 illustrates 12 display panels 12 through 34, for illustrating an advertising message. The actual size of the advertising message is a function of the number of display panels 12 through 34 used and the size of each panel. In the preferred embodiment each panel is approximately 4 inches wide with the complete advertising message being about 48 inches wide.

Figure 2:
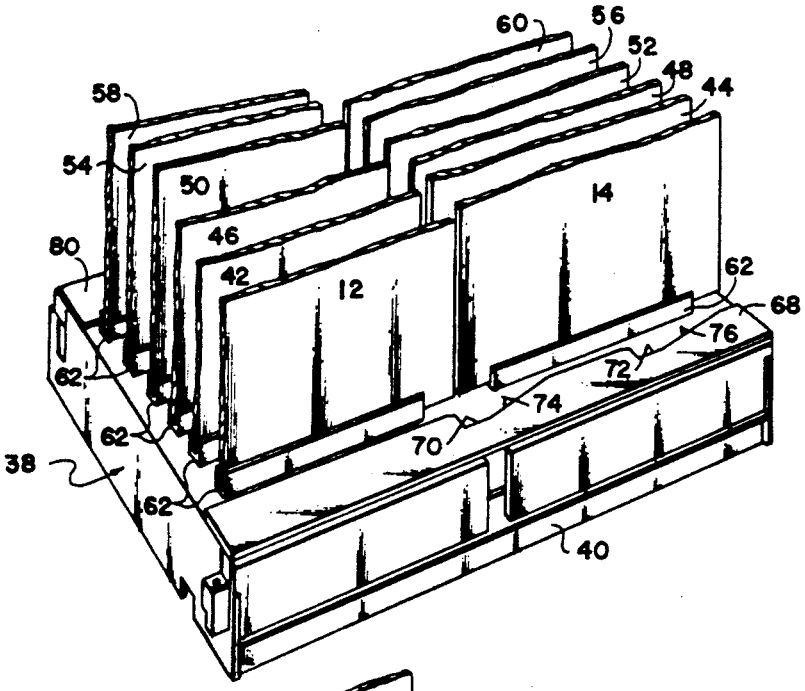
FIG. 2 illustrates a base module comprising a plurality of pairs of panel carriers and display panels forming a part of the complete advertising display.

Referring now to FIG. 2 there is shown a base module 38 capable of handling, moving and displaying two (2) display panels of either 12 and 14 or 16 and 18 or 20 and 22 or 24 and 26 or 28 and 30 or 32 and 34. All display modules 38 are identical and are capable of displaying two display panels on the front longitudinal face 40 of the module 38. Panels 12 and 14 may form the complete advertising message alone or when in combination with display panels 16, 18,20, 22, 24, 26, 28, 30, 32 and 34 may form only a part of the complete message. In the system being described a total of 6 base modules 38 are located on the bottom and the top to move and position the display panels. The description will include only the bottom modules 38; however, the number of modules on the bottom are replicated on the top and all modules are connected together and move as a single unit.

The total number of different advertising messages is a function of the size of the base module 38 in the transverse direction. In the preferred embodiment, determined by size and weight consideration, each base module 38 contains a total of six (6) different advertising messages. Since each message needs two (2) display panels, the base module contains a total of 12 display panels with six (6) display panels located in two (2) opposed transverse tracks. Each different advertising message is comprised, in part, of display panels 12 and 14, 42 and 44, 46 and 48, 50 and 52, 54 and 56 and 58 and 60. The total advertising message illustrated would require 6 base modules 38 to supply a 36 inch message.

Each display panel is held and moved by identical but separate display carriers 62 having a pair of hollow legs 64 and 66 more fully illustrated in connection with FIGS. 14 and 15. The individual display carriers 62 are adapted to support the display panels as the carriers are moved both longitudinally and transversely in a manner to be described.

Located on the front longitudinal face 40 is a sliding rack 64 having a pair of detents 70 and 72 and a camming surface 74 and 76 located in front of each detent respectively. The sliding rack 68 is moveable from a right to left and from a left to right position but is adapted to move a carrier 62 only from a left to right position. In a similar manner there is located on the rear longitudinal surface a sliding rack 80 identical in all respects to rack 68 and capable of moving from the right to the left position and from a left to a right position but is adapted to move a carrier 62 only from a right to left position. In operation both racks 68 and 80 move in unison. When the front rack 68 moves from left to right, the rear rack 80 moves from right to left.

In operation, the display panels are first displayed along the front longitudinal surface 40 and then after a discrete period of time the panels are moved sequentially until all messages have been displayed facing the front longitudinal face 40. In point of order, display panels 12 and 14 are displayed first and then moved from left to right and to the rear and from the rear the panels are moved right to left and then forward to repeat the process sequentially.

The display panels located on the right side and comprising panels 14, 44, 48, 52, 56 and 60 are pushed to the rear by a pusher bar 77 while at the same time panels 12, 42, 46, 50, 54 and 58 located on the left side are pushed forward by pusher bar 78. Pusher bars 77 and 78 are more fully illustrated in connection with FIGS. 8 and 9. The pusher bar 77 causes the hollow legs of display carrier 62 holding display panel 60 to enter detents 70 and 72 located on sliding rack 80 while at the same time pusher bar 78 causes the hollow legs of display carrier 62 holding display panel 12 to detents 70 and 72 located on sliding rack 68.

Moving sliding rack 68 to the right and sliding rack 80 to the left causes display panel 12 to move to the right and display panel 60 to move to the left. This comprises the first step of moving the display carriers from the longitudinal direction to the transverse direction. The sliding racks 68 and 80 are immediately returned with 68 returned to the left and rack 80 returning to the right. This action allows the cam surface 74 and 76 on each rack to contact the panel carrier 62 just transferred and complete the directional turn from a longitudinal direction to a transverse direction. This action places display panel 12 on the right side and display panel 42 on the left side.

At this point in time only one panel of the two panel advertising display has been moved. The process is repeated with the pusher bars 76 and 78 again energized to load carriers 62 holding display panel 42 on rack 68 and load carrier 62 holding panel 56 on loading rack 80 . Energizing racks 68 and 80 now places display panel 42 on the right side and panel 46 on the left side for display purposes. After a discrete period of time the process is repeated over and over to continuously and repetitively show all advertising messages.

The problem solved by the present invention is the tendency of the display carriers 62 to twist when being moved longitudinally and transversely and hence to jam and lock up thereby rendering the display unusable.

Figure 3:
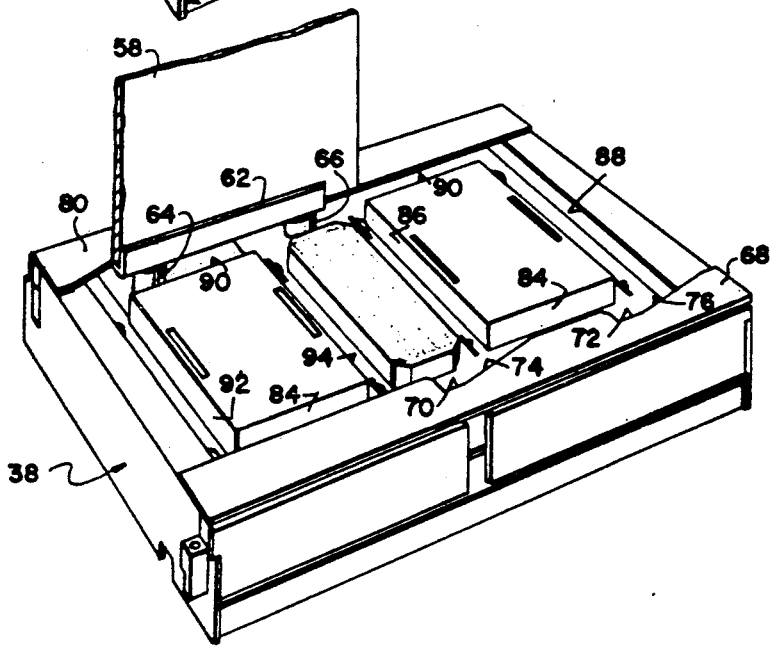
FIG. 3 illustrates details of the base module illustrated in FIG. 2.

Referring now to FIG. 3 there is shown a perspective view of the base module 38 more fully illustrating the single front longitudinal track 84, the right transverse tracks 86 and 88, the single rear longitudinal track 90 and the left transverse tracks 92 and 94. Carrier 62 holding panel 58 is shown moving from the right to the left in the rear longitudinal track 90.

Figure 4:
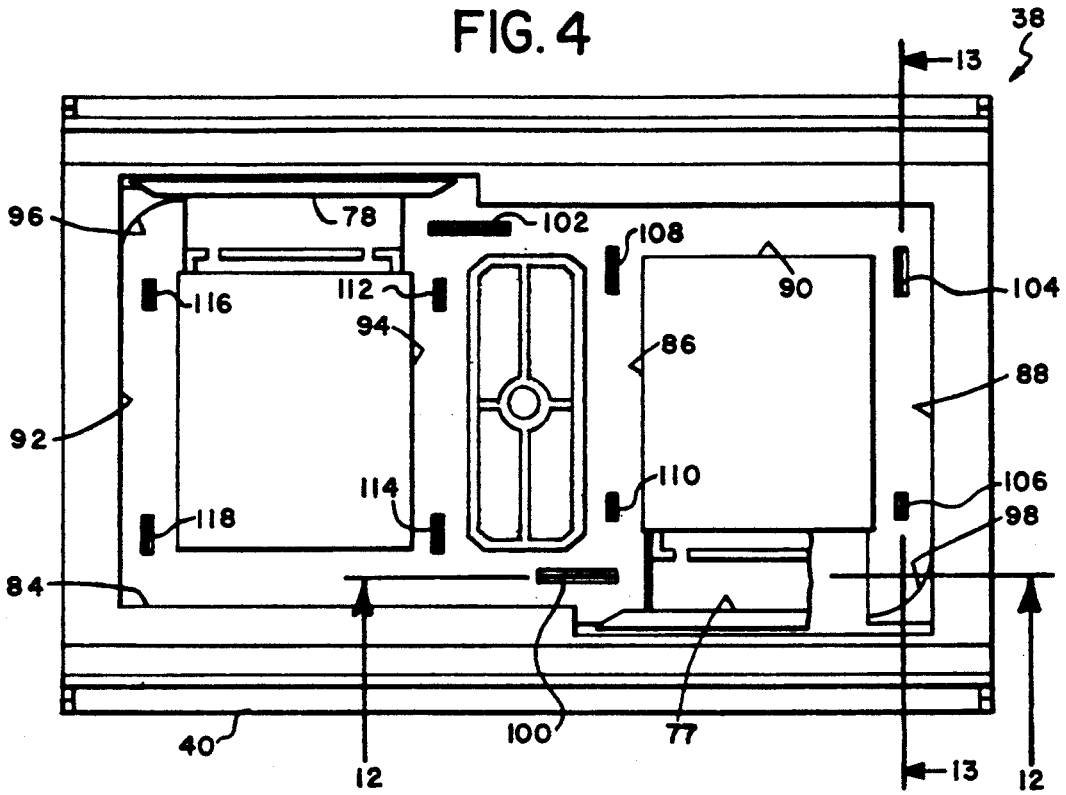
FIG. 4 is a top plan view of the base module illustrated in FIG. 1 showing details of the longitudinal tracks and the transverse tracks.

In the preferred mode as shown in FIG. 4 the individual display panels are moved counterclockwise; however, the movement could just as well be constructed to operated in a clockwise direction. In order to assist the panel carrier 62 located in the rear track 90 in making the transition from longitudinal track 90 to the left transverse tracks 92 and 94 there is located at the junction of tracks 90 and 92 a cam 96. This motion is more fully illustrated in connection with FIGS. 6 through 11. In a similar manner a cam 98 is located at the junction of tracks 84 and 88 in order to assist a carrier 62 from making the transition from longitudinal track 84 to transverse track 88. Obviously if the motion was clockwise the cams 96 and 98 would be placed in the opposite corners.

The individual panel carriers are maintained in a preferred relation when being moved in the individual tracks by means of springs located in the tracks. The front longitudinal track 84 contains a single spring 100 while the rear longitudinal track 90 contains a single spring 102. Each of the transverse tracks contain two (2) springs for alignment purposes. Right transverse track 88 contains springs 104 and 106, right transverse track 86 contains springs 108 and 110, while left transverse track 94 contains springs 112 and 114 and left transverse track 92 contains springs 116 and 118. The push rods 77 and 78 are shown in the retracted position for allowing the panel carriers to traverse both longitudinal tracks 78 and 84.

Figure 5:
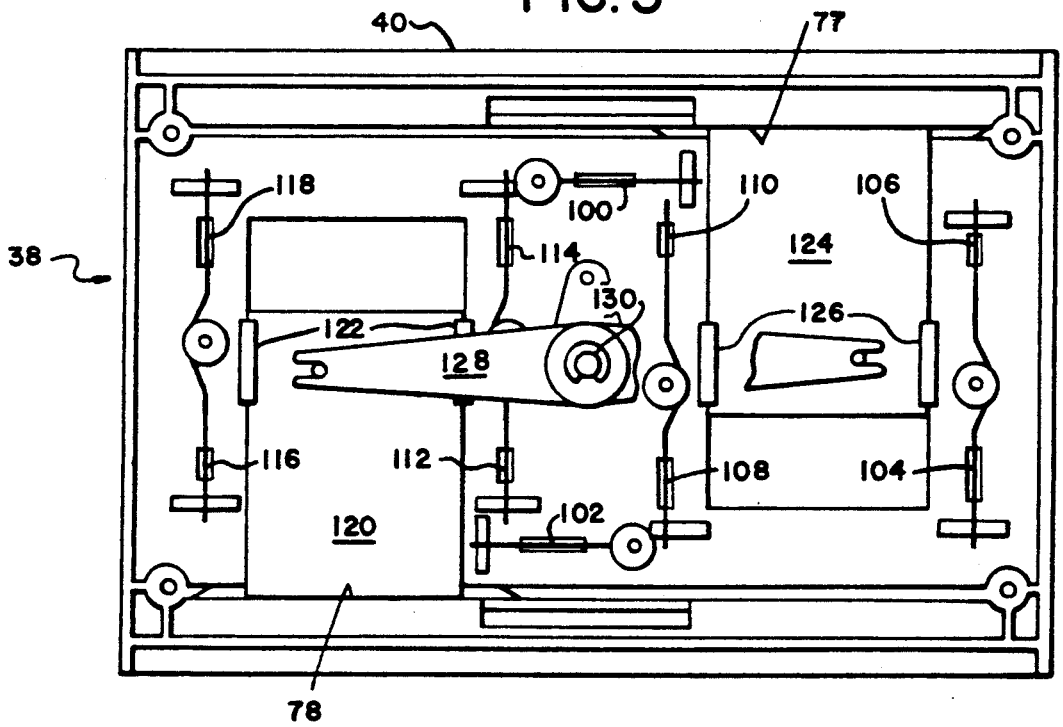
FIG. 5 is a bottom plan view of the base module illustrated in FIG. 2 showing details of the support springs and the pusher bars.

Referring now to FIG. 5 there is shown a bottom plan view of the base module 38 illustrated in FIGS. 2, 3 and 4. The push rod 78 is attached to a rectangular member 120 and is adapted to move in a transverse direction within a pair of guides 122. In a similar manner push rod 77 is attached to a rectangular member 124 and is adapted to move in a transverse direction within a pair of guides 126. The rectangular member 120 and 124 are moved in a fore and aft direction by a swinging arm 128 that is arranged to move about pivot 130 located in the center of the bottom of base module 38. The individual springs described and illustrated in FIG. 4 actually project from the bottom of the module 38 through openings, one for each spring. All of the springs in the transverse tracks are identical and have a projected length into the track that is less then the internal diameter of the legs 64 forming part of the panel carrier 62 as illustrated in FIGS. 14 and 15. In addition all the springs are formed at an angle so as to form a cam in the direction the carrier 62 is moving and in the form of a right angle in the opposite direction to thereby allow the carrier 62 to move in the preferred direction only and prevent movement in the opposite direction.

Referring now to FIG. 12 there is shown a section taken along lines 12—12 of FIG. 4 illustrating spring 100 located in the front longitudinal track 84. Both springs 100 and 102 are identical and are elongated in the longitudinal direction, Spring 100 is located in front of transverse track 86 while spring 102 is located in front of transverse track 94. The action of springs 100 and 102 will be explained in connection with FIGS. 6 through 11.

Referring now to FIG. 13 there is shown a section taken along lines 13—13 of FIG. 4 illustrating springs 104 and 106 located in transverse track 88. Spring 104 has a cammed surface 132 in the forward direction of movement of the carrier 62 and a right angle 134 in the reverse direction thereby preventing reverse movement of the carrier once it has moved past the spring. Springs 108 and 110 in transverse track 86 and springs 112 and 114 in transverse track 94 and springs 116 and 118 located in transverse track 92 are all identical.

Referring now to FIGS. 6 through 11 there is illustrated a single base module 38. The movement of the individual panel carriers 62 will be traced through as they move from the front longitudinal track 84, through the transverse tracks 86 and 88, through the rear longitudinal track 90 and back through the transverse tracks 92 and 94 to the front longitudinal track 84.

Figure 6:
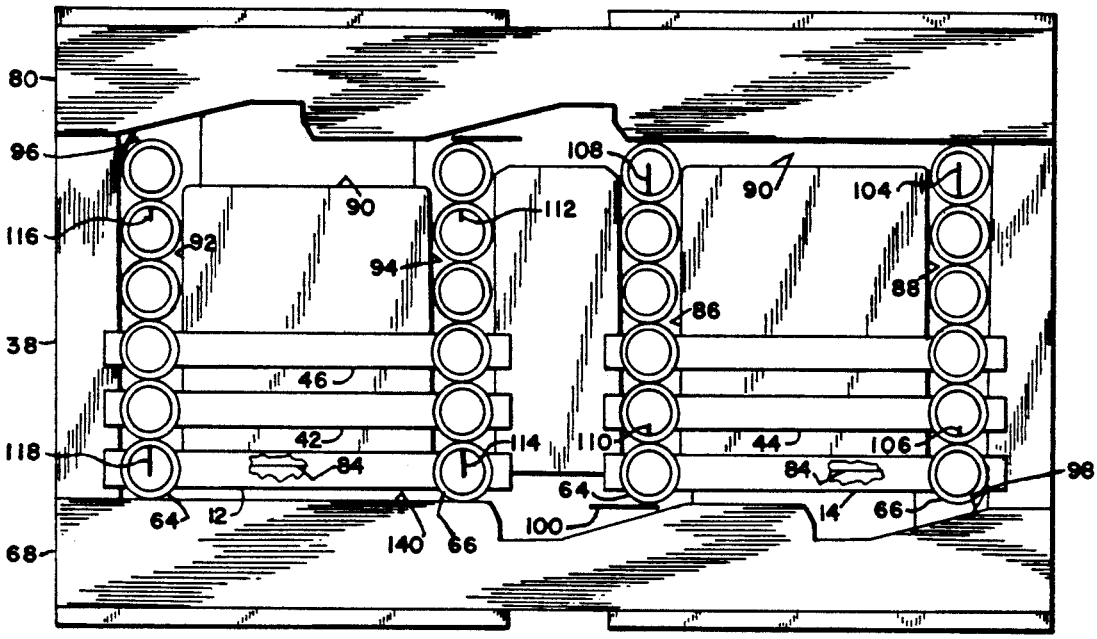
FIGS. 6, 7, 8, 9, 10 and 11 illustrate the movement of the carriers through the longitudinal tracks and the transverse tracks.
Figure 7:
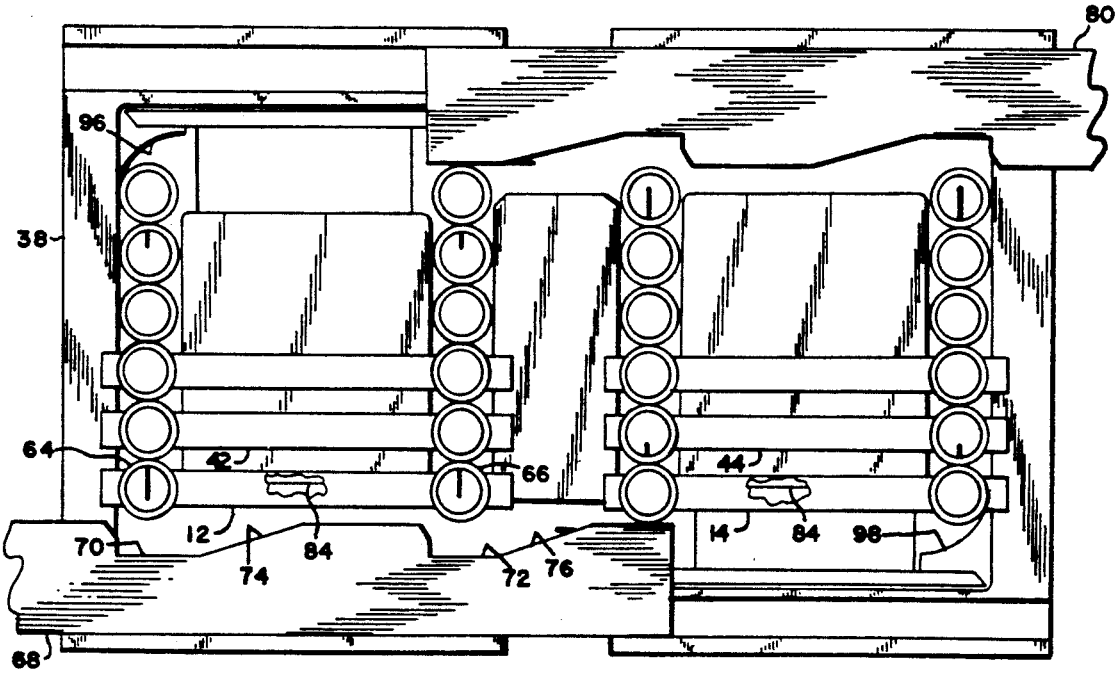

FIG. 6 illustrates the viewing position in which the display panels 12 and 14 are facing the front face 40 for displaying the advertising message to the public. In this starting position display panel 12 is located on the left and display panel 14 is located on the right. This is the display position as shown in FIG. 1 showing rack 68 on the left side and rack 80 on the right side. In this position, the straight portion 140 of rack 78 supports legs 64 and 66 of panel carrier 62 holding display panel 12. The legs 64 of panel carrier 62 holding display panel 14 is held in position by spring 100 located in longitudinal track 84 while leg 66 of panel carrier 62 holding display panel 14 is held in position by contacting cam 98.

In the next step as shown in FIG. 2 the racks 68 and 80 are moved to the opposite positions with rack 68 moving to the left and rack 80 moving to the right. No change is made in the panels which remain in the same viewing position.

Figure 8:
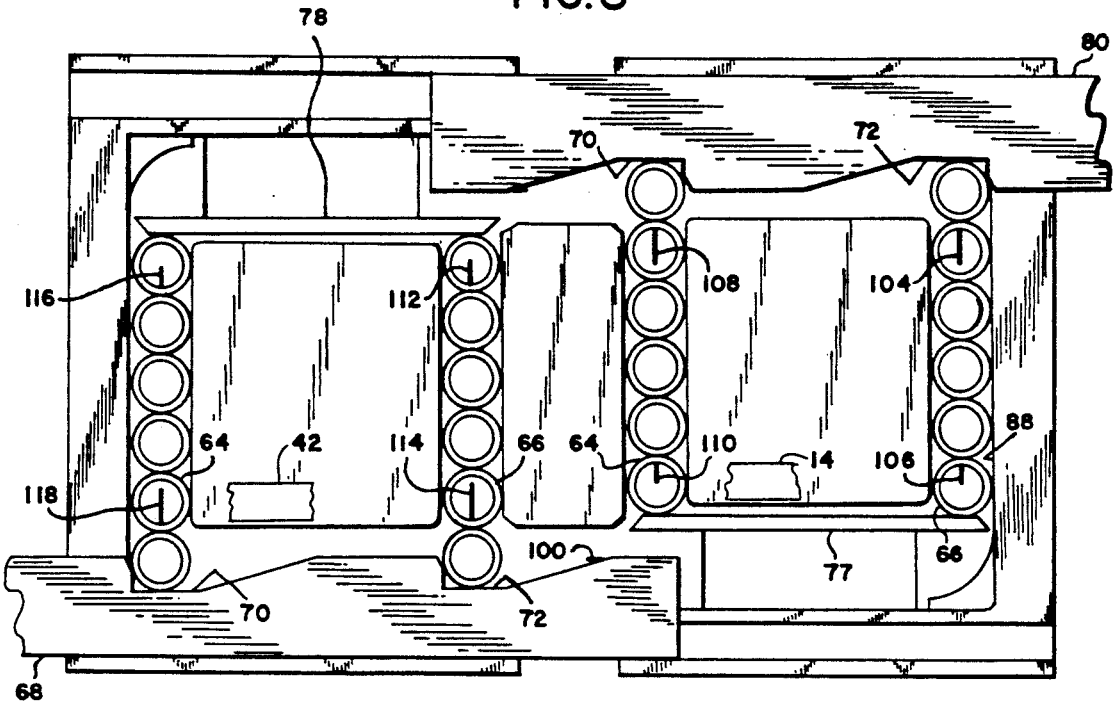

Referring now to FIG. 8 there is shown the actions of pusher bars 77 and 78 being moved with bar 77 moving up to push the legs 64 and 66 of panel carriers 62 into detents 70 and 72 of rack 80 while at the same time pusher bar 78 pushes the legs 64 and 66 of panel carriers 62 into detents 70 and 72 of rack 68. The action of pusher bars 77 and 78 loads the racks 68 and 80 for moving the carriers 62 longitudinally.

In this position the legs 64 and 66 of panel carrier 62 holding panel display 42 are held in place by springs 118 and 114 respectively. The individual springs 118 and 114 fit into the hollow recesses of legs 64 and 66 as shown in FIG. 15 and in this way the carrier is held in position. Because of the shape of the spring which is cammed in the forward direction only, the individual carriers can not move in the opposite direction and are held in position. The same holding action takes place in connection with springs 110 and 106 holding legs 64 and 66 of the carrier 62 holding display panel 14.

Figure 9:
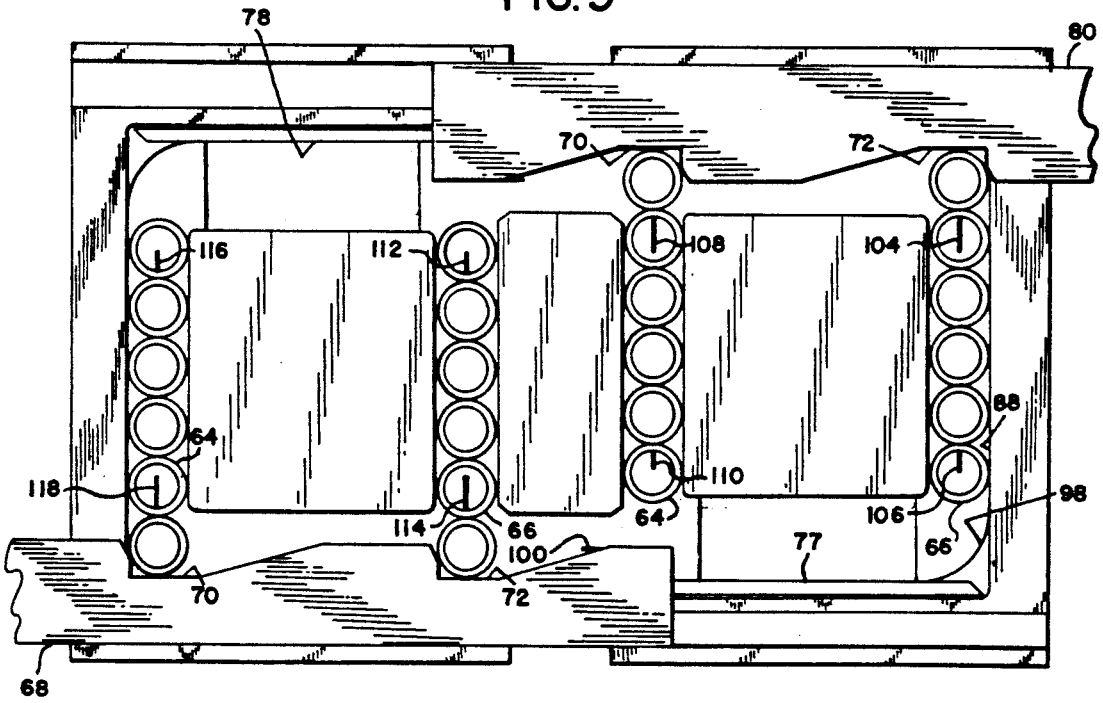

Referring now to FIG. 9 there is shown the pusher bars 77 and 78 in the retracted position with the individual carriers 62 being hold in position by the action of springs 118 and 114 and springs 110 and 106 on the front and spring 116 and 112 and springs 108 and 104 in the rear.

Figure 10:
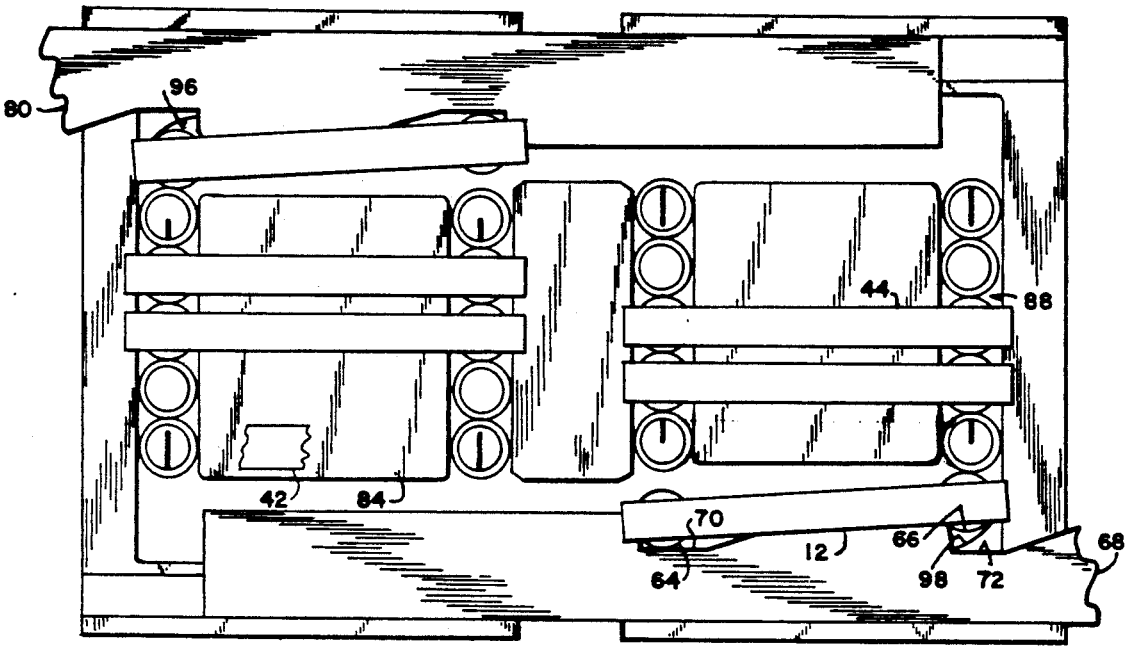

Referring now to FIG. 10 there is shown the rack 68 having moved to the right and rack 80 having moved to the left. The action described for rack 68 is the same as for rack 80. As rack 68 moves to the left, the detents 70 and 72 carry the legs 64 and 68 of the panel carrier to the right. Leg 68 contacts the cam 98 located at the junction of longitudinal track 84 and transverse track 88 As leg 68 contacts the cam 98 the leg 68 is cammed upwards out of the detent 72 thereby causing a turning action of the panel carrier 62 with the other leg 64 still in the detent 70 of the rack 68. This turning action is the first step of changing direction from a longitudinal track to a transverse track and is necessary to prevent a jamming of the carrier 62 into the transverse tracks.

Figure 11:
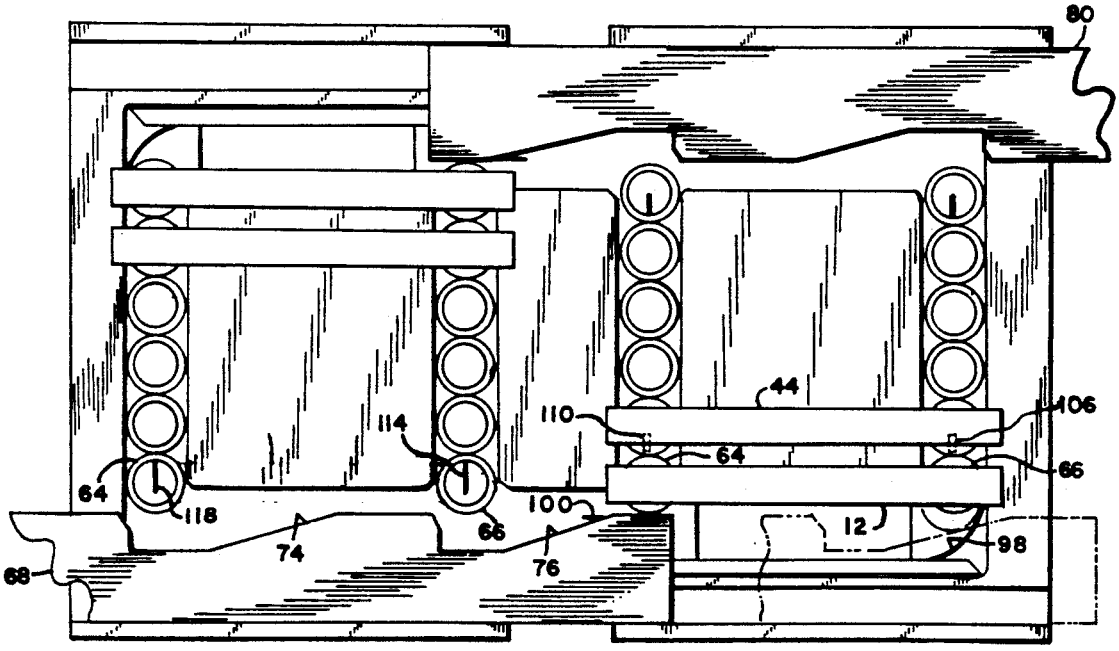

The racks 68 and 80 do not stop but are immediately reversed as shown in FIG. 11 to finish the unloading of the legs 64 and 66 of the carrier 62 holding the display panel 12 from the detents 70 and 72 located in rack 68. As rack 68 moves to the left the cam 74 first contacts leg 66 of the carrier 62 holding display panel 12 and then contacts leg 64 of the carrier holding display panel 12. Transferring the panels and unloading the panels in the same step is a great time saver since a complete transfer of panels requires two complete rotations of panels to remove the old and set up a new display.

The action of the cam 76 on the legs 64 and 68 of the carrier holding display panel 12 allows leg 68 to bear against the cam 98 for support and leg 64 to bear against spring 100 located in the lower longitudinal track 84. In this position display panel 12 is supported by spring 100 and the cam 98 while display panel 44 is supported by springs 110 and 106 and are located within the hollow legs 64 and 68 of the carrier 62 holding display panel 44.

At the same time the legs 64 and 66 of the carrier 62 holding display panel 42 are being held by springs 118 and 114 that are located within the hollow legs of the carrier.

The sequence is again repeated in order to place display panel 42 on the right and display panel 46 on the left for viewing by the public. Since the last step will place the lower rack 68 on the right after delivering display panel 42 it is necessary to quickly move the rack 68 to the left and rack 80 to the right as shown in FIG. 3.

Figure 17:
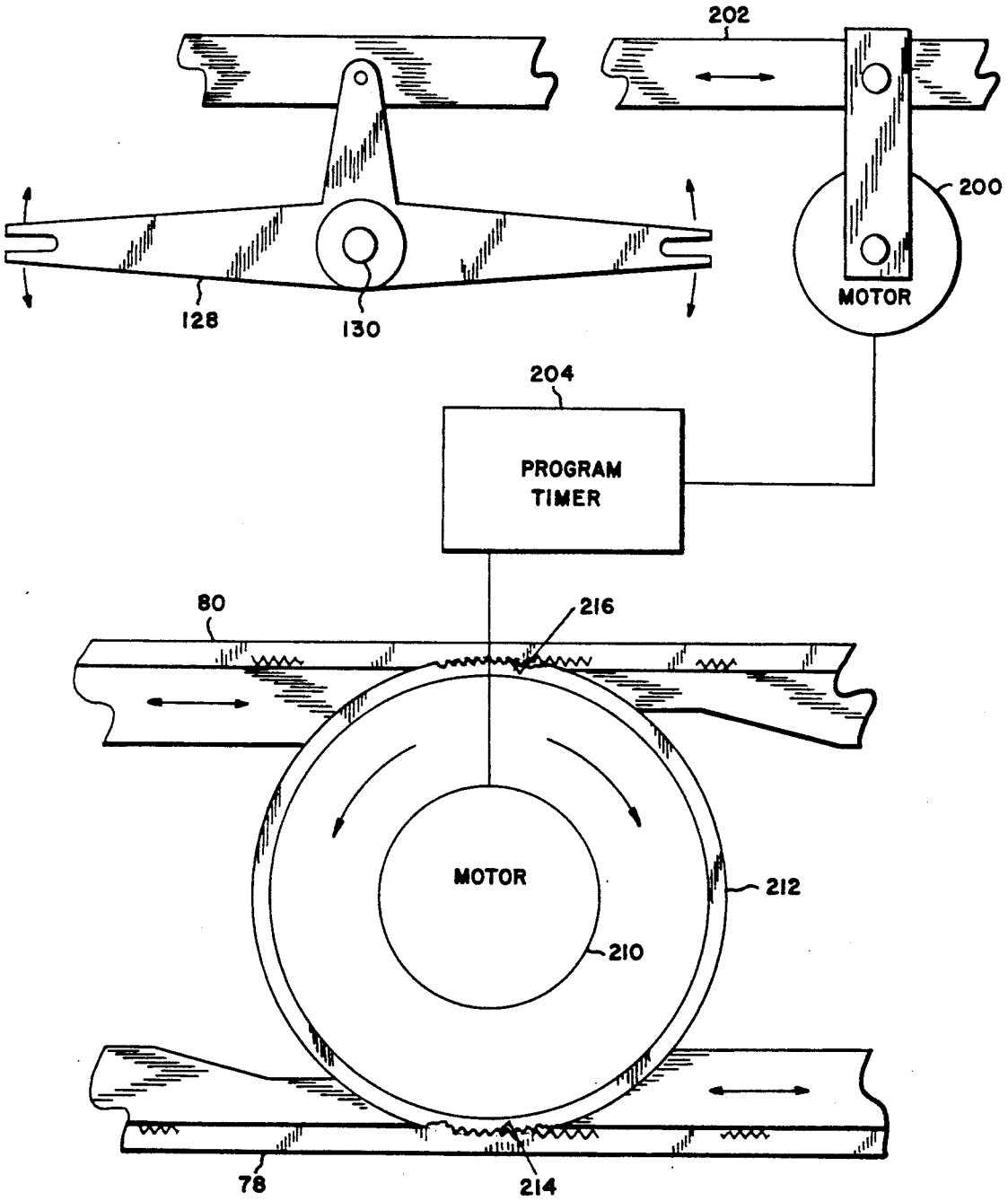
FIG. 17 is a schematic drawing showing the two separate motors used to control movement of the pusher arms and the racks.

Referring now to FIG. 17 there is shown a motor 200 connected to a drive shaft 202 for operating the swing arm 128 that controls the pusher arms 77 and 78. The motor 200 is controlled by a programmed timer 204 that starts and stops the motor 200 at the proper time in the operating cycle.

Also shown in FIG. 17 is a motor 210 located on shaft 130 for driving a bull gear 212 that engages teeth 214 located on rack 68 and teeth 216 located on rack 80. The program timer 204 starts and stops motor 210 at the proper time in the operating cycle. Both motors 200 and 210 are controlled to first operate in one direction and then in the opposite direction at the proper time in the cycle.

The process is repetitive and all racks 68 for all base modules 38 are connected together and move in unison while all racks 80 for all base modules are connected together and move in unison all under control of the motor 210.

In a similar fashion all swinging arms 128 for all base modules 38 are connected together and move in unison all under control of motor 200.

The size of the total advertising display is a function of the number of base modules 38 used. For a 48 inch display a total of 6 base modules are needed on the bottom and 6 modules are needed on top.

The invention disclosed was illustrated with display panels visible on only one side. Depending on the located it is possible to place an advertising message on both side of the panels thereby allowing two advertising messages to be view at the same time and making the display twice as effective as a single display Obviously the display would have to be located in a thruway such as a concourse where the public can view the display while coming or going.

I claim:

1. A moveable display apparatus comprising:

first and second spaced apart longitudinal track means communicating with first and second transverse spaced apart track means extending between said first and second longitudinal track means;

a plurality of pairs of panel carriers for travel in said longitudinal tracks means and said transverse track means;

a plurality of pairs of display panels, each panel mounted on a panel carrier;

said pairs of display panels having a preferred display face whereby each pair of display panels located on one of said longitudinal track means display a desired advertising message;

drive means for sequentially advancing said carriers in a given direction along said longitudinal and transverse means to display a pair of panels comprising an advertising message; and means for preventing said carriers from jamming when being moved from the longitudinal track to the transverse track; and means for preventing said carriers from twisting while in said transverse tracks.

2. A moveable display apparatus according to claim 1 which includes a cam transfer means located in each longitudinal guide means for guiding each of said panel carriers when transferring from said longitudinal track to said transverse tracks.

3. A system according to claim 1 which includes means for maintaining said carriers in a orthagonal relationship to the transverse track when moved in the transverse track.

4. A moveable display apparatus according to claim 1 in which said drive means includes draw bar means for moving said carriers in said longitudinal track means and pusher bar means for moving said carriers in said transverse track means.

5. A moveable display apparatus according to claim 4 in which said draw bar means and said pusher bar means move in a timed relationship with each other.

6. A moveable display apparatus according to claim 4 in which includes a pair of drive means one for each longitudinal track means and one for each pusher bar means associated with each transverse track means.

7. A moveable display apparatus according to claim 1 which includes springs located in all of said track means for maintaining said carriers in a preferred relationship in both said longitudinal tracks and said transverse tracks.

8. A movable display apparatus according to claim 7 in which said carriers are maintained in a orthagonal relationship to the transverse track means when being moved in the transverse track means by springs located in the transverse tracks.

9. A movable display apparatus according to claim 7 in which said panel carriers each comprise a pair of hollow legs adapted to encircle and be supported by said springs located in each of said transverse tracks.

10. A moveable display apparatus according to claim 3 in which said springs are cammed in the direction of movement of said carriers for allowing said carriers to move in the direction of movement only.

11. A moveable display apparatus according to claim 7 in which said springs located in said longitudinal tracks form a bearing surface for said panel carriers as they enter said transverse tracks thereby preventing said panel carriers from moving backward into the longitudinal track.

12. A moveable display apparatus comprising:

an elongated base formed with front and back sides and first and second ends;

first and second spaced apart longitudinal track means on said base and extending between said first and second sides;

first and second transverse spaced apart track means disposed on said base and extending between said first and second longitudinal track means;

a plurality of pairs of panel carriers for travel in said longitudinal tracks means and said transverse track means;

a plurality of pairs of display panels, each mounted on a panel carrier;

said pairs of display panels having a preferred display face whereby each pair of display panels located on one of said longitudinal tracks display a desired advertising message;

drive means for advancing said pairs of carriers sequentially along said longitudinal and transverse tracks to sequentially display said pairs of panels; and means including discrete springs and transfer guides for maintaining a preferred relationship of the carriers when moved along the longitudinal track means and the transverse track means thereby preventing said carriers from twisting and jamming.

* * * * *